United States Patent [19]

Engelhardt et al.

[11] 4,283,849

[45] Aug. 18, 1981

[54] CUTTING UNIT FOR A DRY-SHAVING APPARATUS

[75] Inventors: Manfred Engelhardt; Jan Reinink; Jochem J. de Vries; Eduard W. Tietjens, all of Drachten, Netherlands

[73] Assignee: U.S. Philips Corporation, New York, N.Y.

[21] Appl. No.: 72,277

[22] Filed: Sep. 4, 1979

[30] Foreign Application Priority Data

Sep. 21, 1978 [NL] Netherlands ..... 7809604

[51] Int. Cl.[3] ..... B26B 19/14

[52] U.S. Cl. ..... 30/43.6

[58] Field of Search ..... 30/34.2, 50, 43.4–43.6, 30/43.92, 346.51

[56] References Cited

U.S. PATENT DOCUMENTS

| | | | |
|---|---|---|---|
| 2,280,836 | 4/1942 | Moskovics | 30/43.6 |
| 3,088,205 | 5/1963 | Ellis | 30/34.2 |
| 3,710,442 | 1/1973 | Meyer | 30/43.6 |
| 3,858,316 | 1/1975 | Tietjens | 30/43.6 |
| 3,890,709 | 6/1975 | Tietjens | 30/43.6 |
| 3,962,784 | 6/1976 | Tietjens | 30/43.6 |
| 4,044,463 | 8/1977 | Tietjens | 30/34.2 |
| 4,151,645 | 5/1979 | Tietjens | 30/43.6 |

FOREIGN PATENT DOCUMENTS

| | | | |
|---|---|---|---|
| 1094500 | 5/1955 | France | 30/346.51 |

*Primary Examiner*—Gary L. Smith

*Attorney, Agent, or Firm*—Thomas A. Briody; William J. Streeter; Rolf E. Schneider

[57] ABSTRACT

The movable cutting unit of a dry-shaver comprises a plurality of cutters (23) and a corresponding plurality of hair-pulling blades (24) each arranged in front of one of the cutters for movement therewith relative to the shear plate or foil of the shaver, and each movable relative to the associated cutter for its hair-pulling action. Each hair-pulling blade is mounted for pivoting motion on its associated cutter.

3 Claims, 7 Drawing Figures

CUTTING UNIT FOR A DRY-SHAVING APPARATUS

Figure 1:
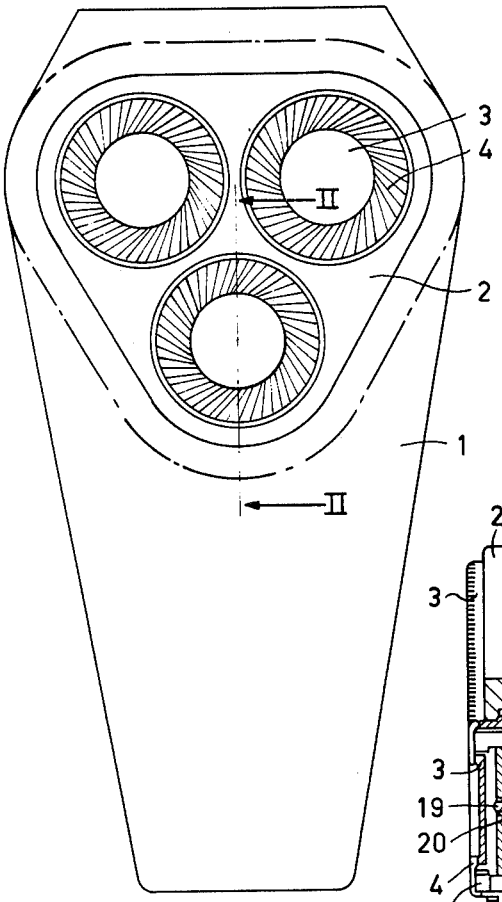

This invention relates to a cutting unit for a dry-shaving apparatus of the kind (hereinafter referred to as "the kind described") having a shear plate or foil with hair-entry apertures and a cutting unit which is movable relative to and cooperates with the shear plate or foil. The invention relates particularly to a cutting unit comprising a plurality of cutters and a plurality of hair-pulling elements each of which is disposed in front of an associated one of the cutters with respect to the direction of the cutting movement thereof and is movable relative thereto and each of which has a sharp edge which, as the hair-pulling element moves over a hair-entry aperture of the shear plate or foil in front of its associated cutter when the cutting unit is in operation in a shaving apparatus, penetrates hairs protruding through that aperture and, by movement of the hair-pulling element relative to the associated cutter under the reaction force from said hairs, moves away from the shear plate or foil and pulls these hairs further through the aperture.

Such a cutting unit is known from U.S. Pat. No. 3,962,784. In this known cutting unit each hair-pulling element has sliding contact over a substantial area with an inclined front surface of its associated cutter, and this contact is sustained throughout the movement of the hair-pulling element relative to the cutter. If hair cuttings or other contaminants get between the hair-pulling element and the cutter, however, the mobility of the former relative to the latter is likely to be impaired or even stopped altogether.

According to the present invention there is provided a cutting unit for a dry-shaving apparatus of the kind described, comprising a plurality of cutters and a plurality of hair-pulling elements each of which is disposed in front of an associated one of the cutters with respect to the direction of the cutting movement thereof and is movable relative thereto and each of which has a sharp edge which, as the hair-pulling element moves over a hair-entry aperture of the shear plate or foil in front of its associated cutter when the cutting unit is in operation in a shaving apparatus penetrates hairs protruding through that aperture and, by movement of the hair-pulling element relative to the associated cutter under the reaction force from said hairs, moves away from the shear plate or foil and pulls these hairs further through the aperture, wherein each hair-pulling element is arranged to pivot on its associated cutter in the hair-pulling movement of the element relative to the cutter.

Preferably, each hair-pulling element has substantially line contact with its associated cutter and is pivotal relative to the cutter about the line of contact.

In one embodiment of the invention each cutter has a groove in which the associated hair-pulling element is pivotal.

In another embodiment each hair-pulling element has a convexly curved surface which has both pivotal and sliding contact with its associated cutter.

Each hair-pulling element may comprise a first portion which projects forwardly in front of its associated cutter and which is formed with said sharp edge, and a second portion which joins the first portion and which, when the cutting unit is mounted in a shaving apparatus, extends from the first portion in a direction away from the shear plate or foil of the shaving apparatus, the hair-pulling element having pivotal contact with the cutter at the junction between the two portions.

The invention further provides a dry-shaving apparatus of the kind described having a cutting unit according to the invention.

Figure 2:
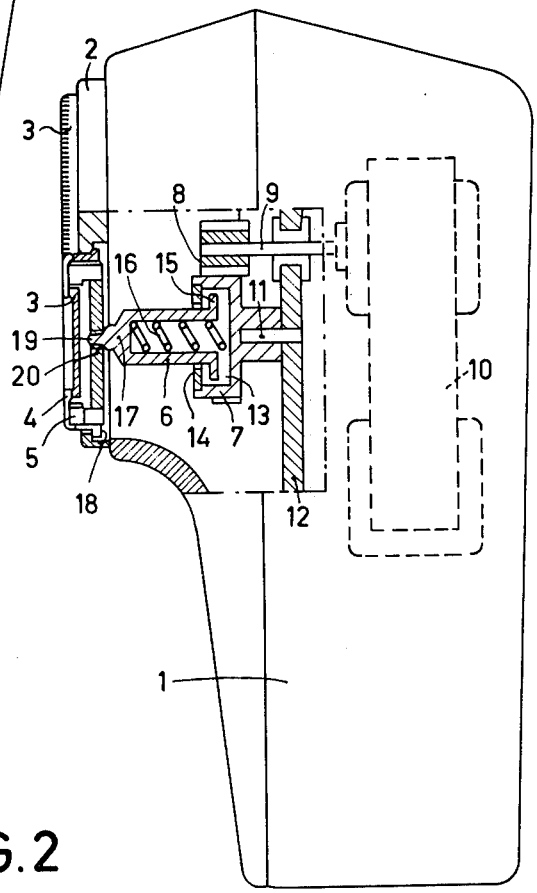
Figure 3:
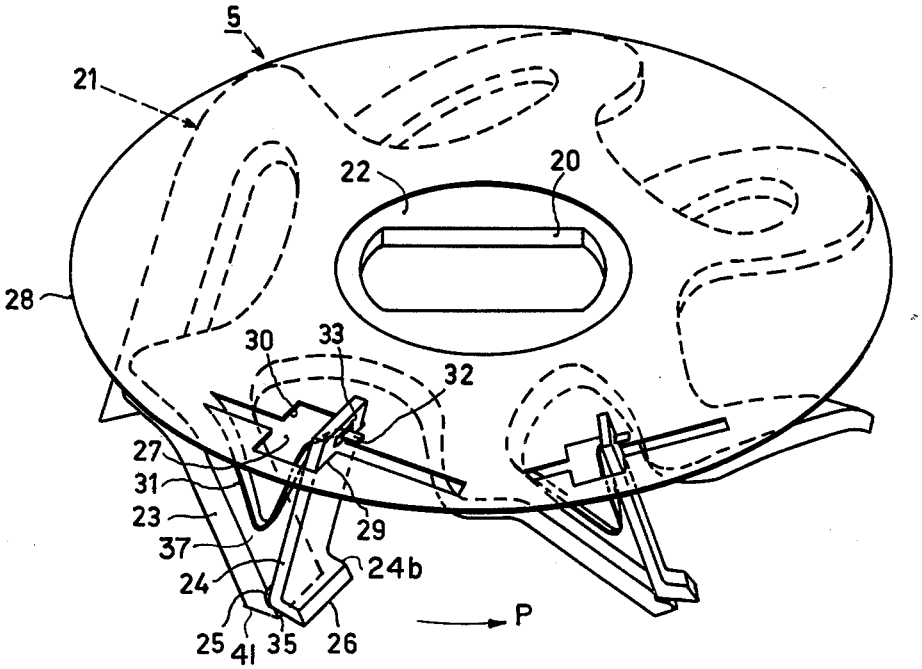
Figure 4:
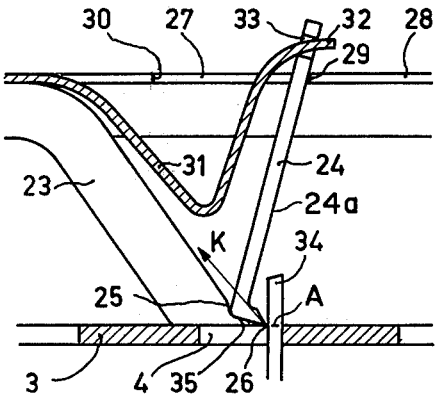
Figure 5:
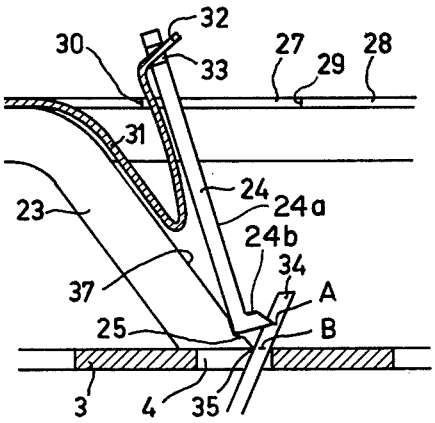
Figure 6:
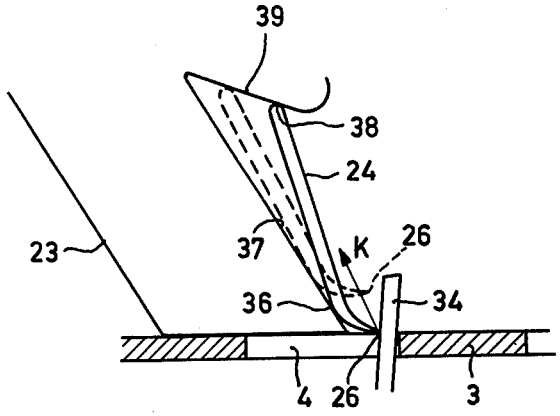
Figure 7:
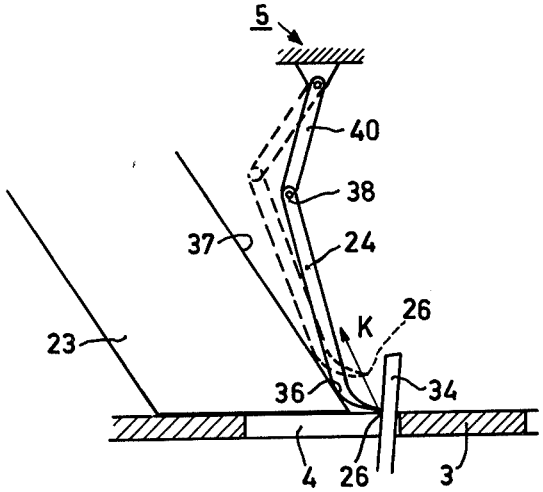

The invention will now be described in detail with reference to the accompanying drawings, in which:

FIG. 1 is a front elevation of a dry-shaving apparatus of the kind described having three shear plates and associated cutting units, FIG. 2 is a side elevation of the shaving apparatus of FIG. 1, showing one of the shear plates and cutting units and an associated driving means in cross-section, the section being taken on the line II—II in FIG. 1, FIG. 3 is a perspective view drawn on an enlarged scale, of an embodiment of a cutting unit according to the invention for the apparatus shown in FIGS. 1 and 2, FIGS. 4 and 5 are diagrammatic side views, drawn on an even larger scale, of a cutter and its associated hair-pulling element of the cutting unit shown in FIG. 3, and a portion of the associated shear plate, illustrating the operation of the hair-pulling element, FIG. 6 is a diagrammatic side view, drawn on an enlarged scale, of a hair-pulling element and part of its associated cutter of a further embodiment of a cutting unit according to the invention, and FIG. 7 is a view similar to FIG. 6 illustrating yet another embodiment of a cutting unit according to the invention.

The shaving apparatus shown in FIGS. 1 and 2 comprises a housing 1 on which is mounted a shear plate holder 2 for three shear plates 3. The shear plates 3 are of circular form and each has a circular pattern of hair-entry apertures in the form of slots 4.

A rotary cutting unit 5 (FIG. 2) is situated on the inner side of each shear plate 3 for cooperation therewith. The cutting units 5, of which one is shown schematically in FIG. 2, each comprises a plurality of cutters in the form of hair-cutting blades, and a corresponding plurality of hair-pulling elements in the form of hair-pulling blades, as will be described hereinafter with reference to FIG. 3.

The cutting units 5 are rotated relative to their shear plates 3 by an electric motor 10 to which each cutting unit is coupled by an associated hollow spindle 6 and a gear wheel 7 and a gear wheel 8 fixed on the shaft 9 of the motor 10. The gear wheels 7 are each rotatably journalled on an associated spindle 11 which is fixed in a mounting plate 12. Each gear wheel 7 has a recess 13 which is closed by a cover plate 14. This recess accommodates a flange 15 formed at the open end of the hollow spindle 6. The flange 15 has a non-circular, for example, square, shape and the recess 13 is shaped accordingly, so that a coupling is obtained for the transmission of the rotary movement of the gear wheel 7 to the spindle 6. A spring 16, which for its greater part is situated in the hollow spindle 6 and which is compressed between the end wall of the hollow spindle 6 and the end wall of the recess 13 in the gear wheel 7, exerts a force on the spindle 6 in the direction of the cutting unit 5. A conical portion 17 of the spindle 6 bears against the cutting unit 5 to transmit this force to the cutting unit and via the cutting unit to the shear plate 3, so that the flange 18 around the periphery of the shear plate is urged against the shear plate holder 2. During use of the shaving apparatus, the shear plates 3, together with their respective associated cutting units 5 and spindles 6, can be pressed inwards against the action of the respective springs 16 under the pressure with which the shear plates are held against the user's skin.

A coupling for the transmission of the rotary movement of each spindle 6 to the associated cutting unit 5 is formed by the end portion 19 of the spindle 6 of substantially rectangular cross-section engaging in a central coupling aperture 20 of corresponding shape in the cutting unit 5.

All three cutting units of the apparatus of FIGS. 1 and 2 are coupled to the motor 10 in the above manner, the three gear wheels 7 meshing with the one centrally disposed gear wheel 8 on the motor shaft 9.

As shown in FIG. 3, each cutting unit 5 comprises a cutting member 21 which includes a central body 22 on which is formed a plurality of hair-cutting blades 23, which are evenly distributed around the periphery of the central body 22. The coupling aperture 20 is formed in the central body 22. As shown in FIGS. 3, 4 and 5, each hair-cutting blade 23 has at its front (with respect to the direction of movement P of the blade) a rearwardly sloping surface 37 which forms an acute angle with a surface 41 which is in sliding contact with the inner side of the respective shear plate 3. The edge 35 at which the surfaces 37 and 41 meet is the cutting edge of the hair-cutting blade. In the operation of the shaving apparatus the sliding surface 41 of each hair-cutting blade travels over the hair-entry slots 4 in the respective shear plate and the cutting edge 35 of the blade, in cooperation with the shear plate at the boundaries of the slots, severs the hairs which protrude through the slots.

Each cutting unit 5 also includes a plurality of hair-pulling blades 24 which are arranged one in front of each hair-cutting blade 23. Each hair-pulling blade 24 is pivotally supported on the rearwardly sloping front surface 37 of its associated hair-cutting blade 23. For this purpose each hair-pulling blade 24, in the embodiment of FIGS. 3, 4 and 5, is sharply bent so that it has the shape of an elongated L, and at the bend, on the outer side thereof, the blade engages rockably in a groove 25 in the front surface 37 of the hair-cutting blade 24. The groove extends across the surface 37 adjacent and substantially parallel to the cutting edge 35 of the hair-cutting blade. The hair-pulling blade has substantially line contact with the hair-cutting blade in the groove 25, which contact extends substantially parallel to the cutting edge of the hair-cutting blade and provides the pivotal support of the hair-pulling blade. The longer arm **24*a* of each hair-pulling blade 24 extends in a direction away from the shear plate 3 through an associated aperture 27 in a disc 28 which is fixed to the central body 22 of the cutting member 21, for example by spot-welding. Each aperture 27 is large enough to allow the respective hair-pulling blade 24 to pivot on the associated hair-cutting blade 23 and has two opposed walls 29 and 30 which are constructed to serve as stops for limiting the pivotal movement of the hair-pulling blade. The longer arm 24*a* of each hair-pulling blade is urged in a forward direction towards the associated stop 29 by an associated leaf spring 31 which is cut and bent from the disc 28. This urges the shorter arm 24*b* of the blade towards the shear plate 3. Each hair-pulling blade 24 is also coupled to the disc 28 and thus to the cutting member 21 by the associated leaf spring 31, the free end 32 of which passes through an opening 33 in the longer arm 24*a* of the hair-pulling blade. The opening 33 is situated on the opposite side of the disc 28 to the place where the hair-pulling blade is in contact with the associated hair-cutting blade, so that when the hair-pulling blade is in abutment with the associated stop 29 the force of the spring 31 acts to hold the hair-pulling blade in contact with the hair-cutting blade. The shorter arm 24*b* of each hair-pulling blade extends forwardly in front of the associated hair-cutting blade and at its forward end is formed with a sharp edge 26**. This edge extends parallel with the axis of the bend in the hair-pulling blade and therefore parallel with the line of contact between this blade and the hair-cutting blade.

The operation of a hair-pulling blade 24 will now be explained with reference to FIGS. 4 and 5. When a hair 34 is caught in a hair-entry aperture 4, the sharp edge 26 of the hair-pulling blade 24 moving in the direction of the arrow P, will contact the hair at location A thereon (FIG. 4). The edge 26 has a sharpness such that it will slightly penetrate the hair 34 at A without severing it. A reaction force K is exerted on the hair-pulling blade 24 by the hair 34, which force causes the hair-pulling blade 24 to pivot on the associated hair-cutting blade 23 so that the sharp edge 26 of the hair-pulling blade moves away from the shear plate 3. As a result of inter alia, the natural elasticity of the user's skin, the hair 34 is pulled further through the hair-entry aperture 4 by the edge 26 of the hair-pulling blade until the cutting edge 35 of the hair-cutting blade 23 has reached the hair at location B thereon (FIG. 5). The hair is then cut by the blade 23 in cooperation with the shear plate 3. Thus, a length of the hair 34 is cut which is longer by an amount equal to the distance between A and B than the length which would be cut off without the aid of the hair-pulling blade, so that a closer shave is obtained.

The pivotal movement of the hair-pulling blade 24 by the reaction force K takes place against the action of the associated leaf spring 31. When hair 34 has been cut off, the spring 31 urges the hair-pulling blade 24 back into its initial position (FIG. 4), in which position the sharp edge 26 of the hair-pulling blade engages the shear plate 3 under a slight pressure from the spring 31.

In the embodiment of FIG. 6, each hair-pulling blade 24 has a convexly curved surface 36 at the outer side of the bend between the longer arm and the shorter arm of the blade, which is still basically L-shaped, and this curved surface 36 has both sliding and rolling contact with the rearwardly inclined front surface 37 of the associated hair-cutting blade 23, which surface is not grooved in this embodiment. In operation the hair-pulling blade 24, under the reaction force K, slides on the front surface 37 of the hair-cutting blade 23 in a direction away from the shear plate 3, with the result that the sharp edge 26 of the hair-pulling blade 24 moves away from the shear plate and pulls the hair 34 which has been penetrated by the edge 26 further through the hair-entry aperture 4. At the same time, a guide surface 39 on the hair-cutting blade 23 deflects the end 38 of the hair-pulling blade 24 which is remote from the shear plate 3 in a rearward direction so that the curved surface 36 of the hair-pulling blade 24 rolls on the front surface 37 of the hair-cutting blade 23 and thereby moves the edge 26 of the hair-pulling blade 24 further from the shear plate 3 to pull the hair 34 even further through the hair-entry aperture 4. The hair-pulling blade 24 now occupies the position shown in broken lines in FIG. 6. When the hair 34 has been cut off by the hair-cutting blade 23, the hair-pulling blade 24 returns to its initial position under the influence of a resilient element which is not shown in the drawings.

The embodiment shown in FIG. 7 is similar to that shown in FIG. 6 except that the end 38 of each hair-pulling blade 24 is deflected rearwardly by a link 40 which connects the blade to the cutting unit 5, instead of by the guide surface 39.

The invention is not limited to a cutting unit of the rotary type; it can also be applied to a reciprocatory cutting unit, for example.

I claim:

1. A shaving apparatus having a shear plate provided with hair-entrance apertures and a cutting unit associated with and drivable relative to the shear plate; said cutting unit comprising a cutting member, cutters extending from said cutting member toward the shear plate, each cutter having a front wall sloping rearwardly with reference to the direction of movement of the cutting unit, and lead cutters, respectively associated with and movable relative to the cutters, each lead cutter engaging the front wall of its associated cutter along a contact line, each lead cutter being bent in substantially the shape of an L with the open portion of the L facing in the direction of movement of the cutting unit, said L-shaped lead cutter being pivotal in the area of its bend relative to the cutter about said contact line.

2. A shaving apparatus according to claim 1, in which each cutter is formed with a groove at the contact line for pivotal engagement by its associated L-shaped lead cutter.

3. A shaving apparatus according to claim 1, in which each L-shaped lead cutter is convexly curved in the area of its bend for both pivotal and sliding engagement with its associated cutter.

* * * * *